US008261382B2

(12) United States Patent
Kanthasamy

(10) Patent No.: US 8,261,382 B2
(45) Date of Patent: Sep. 11, 2012

(54) PROVIDING VARYING DEGREES OF ELEVATION TO MOVEABLE HEAD-REST AND BACK-SUPPORT SECTIONS OF BED FRAME

(75) Inventor: Abedan Kanthasamy, Kuala Lumpur (MY)

(73) Assignee: Lifestyle Solutions, Inc., Fremont, CA (US)

( * ) Notice: Subject to any disclaimer, the term of this patent is extended or adjusted under 35 U.S.C. 154(b) by 297 days.

(21) Appl. No.: 12/683,511

(22) Filed: Jan. 7, 2010

(65) Prior Publication Data

US 2011/0162144 A1 Jul. 7, 2011

(51) Int. Cl.
*A47C 20/16* (2006.01)
*A47C 20/04* (2006.01)

(52) U.S. Cl. ..... 5/613; 5/617; 5/236.1; 16/368; 16/323

(58) Field of Classification Search ..... 5/193, 613, 5/617, 634, 236.1, 200.1, 310; 16/343–347, 16/362, 363, 368, 369, 319, 323
See application file for complete search history.

(56) References Cited

U.S. PATENT DOCUMENTS

| | | | | | |
|---|---|---|---|---|---|
| 3,061,843 | A * | 11/1962 | Singer et al. | ..... | 5/618 |
| 3,353,193 | A * | 11/1967 | Greiner | ..... | 5/617 |
| 4,251,891 | A * | 2/1981 | Degen | ..... | 5/191 |
| 5,758,372 | A * | 6/1998 | Lopez Diaz | ..... | 5/200.1 |
| 5,978,992 | A * | 11/1999 | Antinori | ..... | 5/658 |
| 6,131,215 | A | 10/2000 | Lindell | | |
| 6,219,863 | B1 * | 4/2001 | Loberg et al. | ..... | 5/236.1 |
| 6,701,550 | B2 * | 3/2004 | Baeriswyl | ..... | 5/236.1 |
| 2008/0244827 | A1 * | 10/2008 | Caon et al. | ..... | 5/200.1 |

FOREIGN PATENT DOCUMENTS

| | | | |
|---|---|---|---|
| DE | 4208819 | A1 * | 9/1993 |
| WO | WO 8809139 | A1 * | 12/1988 |

* cited by examiner

*Primary Examiner* — Michael Trettel
(74) *Attorney, Agent, or Firm* — Robert A. Voigt, Jr.; Winstead P.C.

(57) ABSTRACT

A bed frame having the functionality of providing varying degrees of elevation to moveable head-rest and back-support sections of the bed frame. Adjustable arms couple a pivotal section of the frame of slats with a front rail panel. The pivotal section of the frame of slats is positioned in the head-rest and back-support sections of the bed frame. Since the pivotal section of the frame of slats is configurable to be tilted, the adjustable arms may be used to tilt the pivotal section of the frame of slats and hence tilt the head-rest and back-support sections of the bed frame to varying degrees of elevation.

21 Claims, 7 Drawing Sheets

PROVIDING VARYING DEGREES OF ELEVATION TO MOVEABLE HEAD-REST AND BACK-SUPPORT SECTIONS OF BED FRAME

TECHNICAL FIELD

The present invention relates to bed frames, and more particularly to a bed frame with the functionality of providing varying degrees of elevation to moveable head-rest and back-support sections of the bed frame.

BACKGROUND OF THE INVENTION

A bed frame is the part of the bed used to hold a mattress off the floor. Bed frames are typically made of wood or metal. Conventional bed frames are typically horizontal and flat and may include head, foot and side rails. Usually, the bed frame is supported by what are known as "legs" on each corner of the bed frame. The mattress is then placed on top of the bed frame.

Oftentimes, people enjoy watching television while lying in their bed. However, since the bed frame, and hence the mattress lying on top of the bed frame, is horizontally level, the head of the individual lying on the bed is horizontally level with the mattress. As a result, it may be difficult to watch the television set without having the head propped up, such as with multiple pillows. However, if the bed frame had the functionality of providing varying degrees of elevation, such as where a person would lay his/her head on the mattress, then the user may be able to select the perfect position for his/her head to view the television set without the need of using multiple pillows. Another reason why a person may want his/her head to be elevated includes having the ability to read comfortably on the bed. A further reason is that there may be those with a medical condition, such as acid reflex or breathing difficulties, that requires them to sleep with their head elevated at an angle.

Beds with moveable head rest and back rest sections commonly use complex motors, electronics, and other means for providing automatic changes to the elevation of the moveable sections. However, such beds are bulky and expensive.

Therefore, there is a need in the art for a relatively inexpensive bed frame having a less complex manual mechanism for providing the functionality of providing varying degrees of elevation to moveable head-rest and back-support sections of the bed frame.

BRIEF SUMMARY OF THE INVENTION

In one embodiment of the present invention, a bed frame comprises a first frame. The first frame comprises two side rail panels and a front rail panel secured at the head board end of each of the two side rail panels via a first and a second bracket. Further, the first frame comprises a rear rail panel secured at the foot board end of each of the two side rail panels via a third and a fourth bracket. The bed frame further comprises a leg secured to each of the first, second, third and fourth brackets to support the first frame. Additionally, the bed frame comprises a second frame with slats secured to the inner portions of the front rail panel, the rear rail panel and the two side rail panels of the first frame. The second frame with slats comprises a first section of slats pivotally connected to a second section of slats, where the first section of slats is positioned in head-rest and back-support sections of the bed frame configurable to be tilted. Furthermore, the bed frame comprises a first guardrail placed on the foot board of the second frame with slats to secure a mattress so that it does not move relative to the boundaries of the second frame with slats. Additionally, the bed frame comprises a second guardrail placed on one side of the second frame with slats to further secure the mattress so that it does not move relative to the boundaries of the second frame with slats. In addition, the bed frame comprises a third guardrail placed on the opposite side of the second frame with slats to further secure the mattress so that it does not move relative to the boundaries of the second frame with slats. Furthermore, the bed frame comprises two adjustable arms secured to the front rail panel and to the first section of slats of the second frame thereby providing tilting capability of the first section of slats of the second frame, where each of the two adjustable arms comprises a support arm and a lever arm. The support arm is coupled to the front rail panel and to one end of the lever arm. The lever arm comprises a plurality of notches, where each of the plurality of notches corresponds to an elevated position of the first section of slats of the second frame, where a guide mechanism is used to select a particular notch of the plurality of notches.

In another embodiment of the present invention, a bed comprises a bed frame that includes a first frame. The first frame comprises two side rail panels and a front rail panel secured at the head board end of each of the two side rail panels via a first and a second bracket. Further, the first frame comprises a rear rail panel secured at the foot board end of each of the two side rail panels via a third and a fourth bracket. The bed frame further comprises a leg secured to each of the first, second, third and fourth brackets to support the first frame. Additionally, the bed frame comprises a second frame with slats secured to the inner portions of the front rail panel, the rear rail panel and the two side rail panels of the first frame. The second frame with slats comprises a first section of slats pivotally connected to a second section of slats, where the first section of slats is positioned in head-rest and back-support sections of the bed frame configurable to be tilted. Furthermore, the bed frame comprises a first guardrail placed on the foot board of the second frame with slats to secure a mattress so that it does not move relative to the boundaries of the second frame with slats. Additionally, the bed frame comprises a second guardrail placed on one side of the second frame with slats to further secure the mattress so that it does not move relative to the boundaries of the second frame with slats. In addition, the bed frame comprises a third guardrail placed on the opposite side of the second frame with slats to further secure the mattress so that it does not move relative to the boundaries of the second frame with slats. Furthermore, the bed frame comprises two adjustable arms secured to the front rail panel and to the first section of slats of the second frame thereby providing tilting capability of the first section of slats of the second frame, where each of the two adjustable arms comprises a support arm and a lever arm. The support arm is coupled to the front rail panel and to one end of the lever arm. The lever arm comprises a plurality of notches, where each of the plurality of notches corresponds to an elevated position of the first section of slats of the second frame, where a guide mechanism is used to select a particular notch of the plurality of notches. The bed further comprises a mattress placed on the bed frame.

The foregoing has outlined rather generally the features and technical advantages of one or more embodiments of the present invention in order that the detailed description of the present invention that follows may be better understood. Additional features and advantages of the present invention will be described hereinafter which may form the subject of the claims of the present invention.

BRIEF DESCRIPTION OF THE SEVERAL VIEWS OF THE DRAWING

A better understanding of the present invention can be obtained when the following detailed description is considered in conjunction with the following drawings, in which.

DETAILED DESCRIPTION OF THE INVENTION

The present invention comprises a bed frame having the functionality of providing varying degrees of elevation to moveable head-rest and back-support sections of the bed frame. In one embodiment of the present invention, adjustable arms couple a pivotal section of the frame of slats with a front rail panel. The pivotal section of the frame of slats is positioned in the head-rest and back-support sections of the bed frame. Since the pivotal section of the frame of slats is configurable to be tilted, the adjustable arms may be used to tilt the pivotal section of the frame of slats and hence tilt the head-rest and back-support sections of the bed frame to varying degrees of elevation.

As discussed in the Background section, oftentimes, people enjoy watching television while lying in their bed. However, since the bed frame, and hence the mattress lying on top of the bed frame, is horizontally level, the head of the individual lying on the bed is horizontally level with the mattress. As a result, it may be difficult to watch the television set without having the head propped up, such as with multiple pillows. However, if the bed frame had the functionality of providing varying degrees of elevation, such as where a person would lay his/her head on the mattress, then the user may be able to select the perfect position for his/her head to view the television set without the need of using multiple pillows. Another reason why a person may want his/her head to be elevated includes having the ability to read comfortably on the bed. A further reason is that there may be those with a medical condition, such as acid reflex or breathing difficulties, that requires them to sleep with their head elevated at an angle. Furthermore, beds with moveable head rest and back rest sections commonly use complex motors, electronics, and other means for providing automatic changes to the elevation of the moveable sections. However, such beds are bulky and expensive. Therefore, there is a need in the art for a relatively inexpensive bed frame having a less complex manual mechanism for providing the functionality of providing varying degrees of elevation to moveable head-rest and back-support sections of the bed frame.

Figure 2:
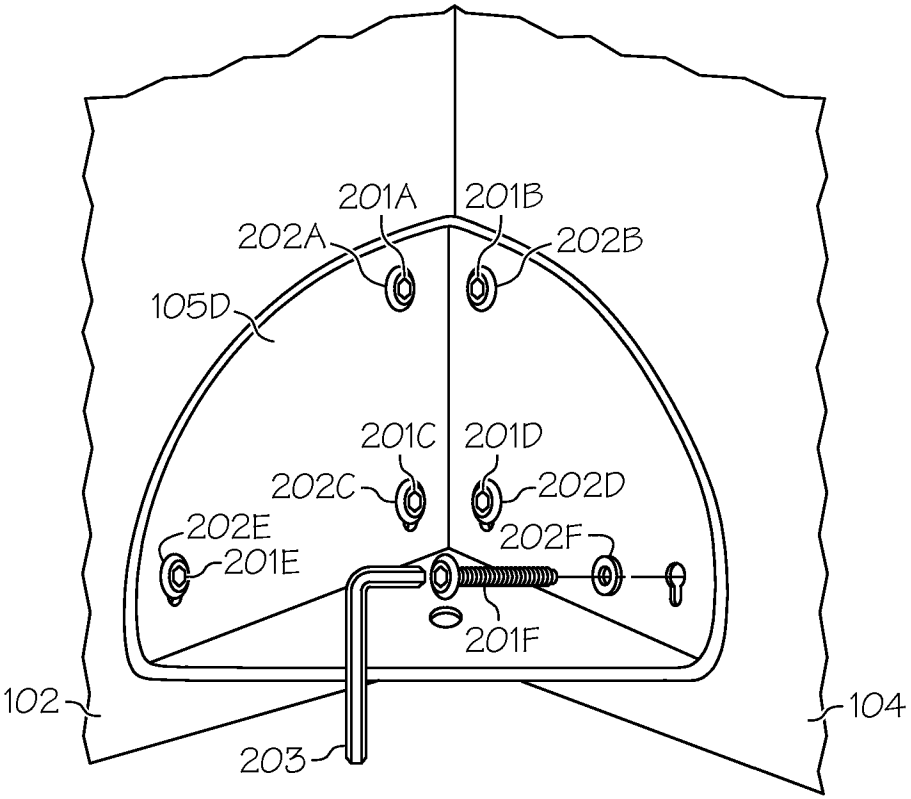
FIG. 2 is an expanded view showing the front and rear rail panels being secured to the side rail panels via brackets in accordance with an embodiment of the present invention.
Figure 1:
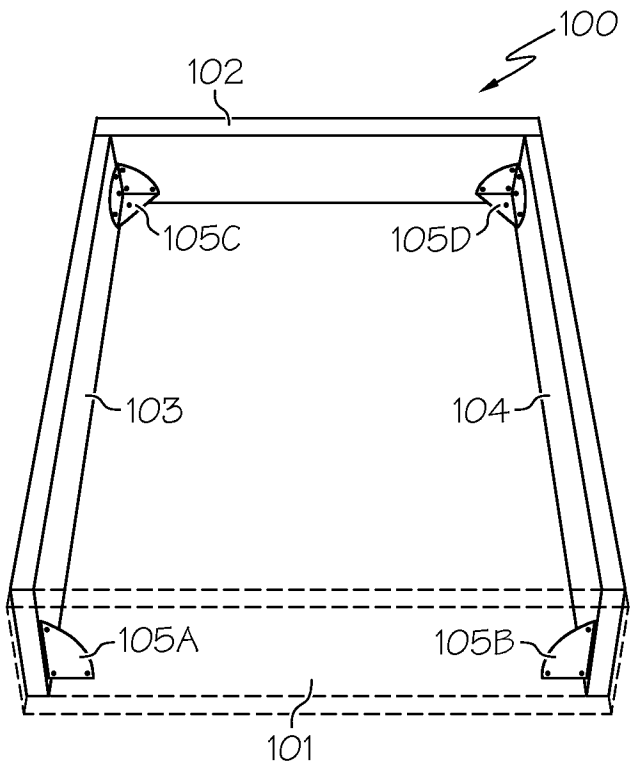
FIG. 1 illustrates a view of the front, rear and side rail panels of the outer first frame of the bed frame in accordance with an embodiment of the present invention.
Figure 3:
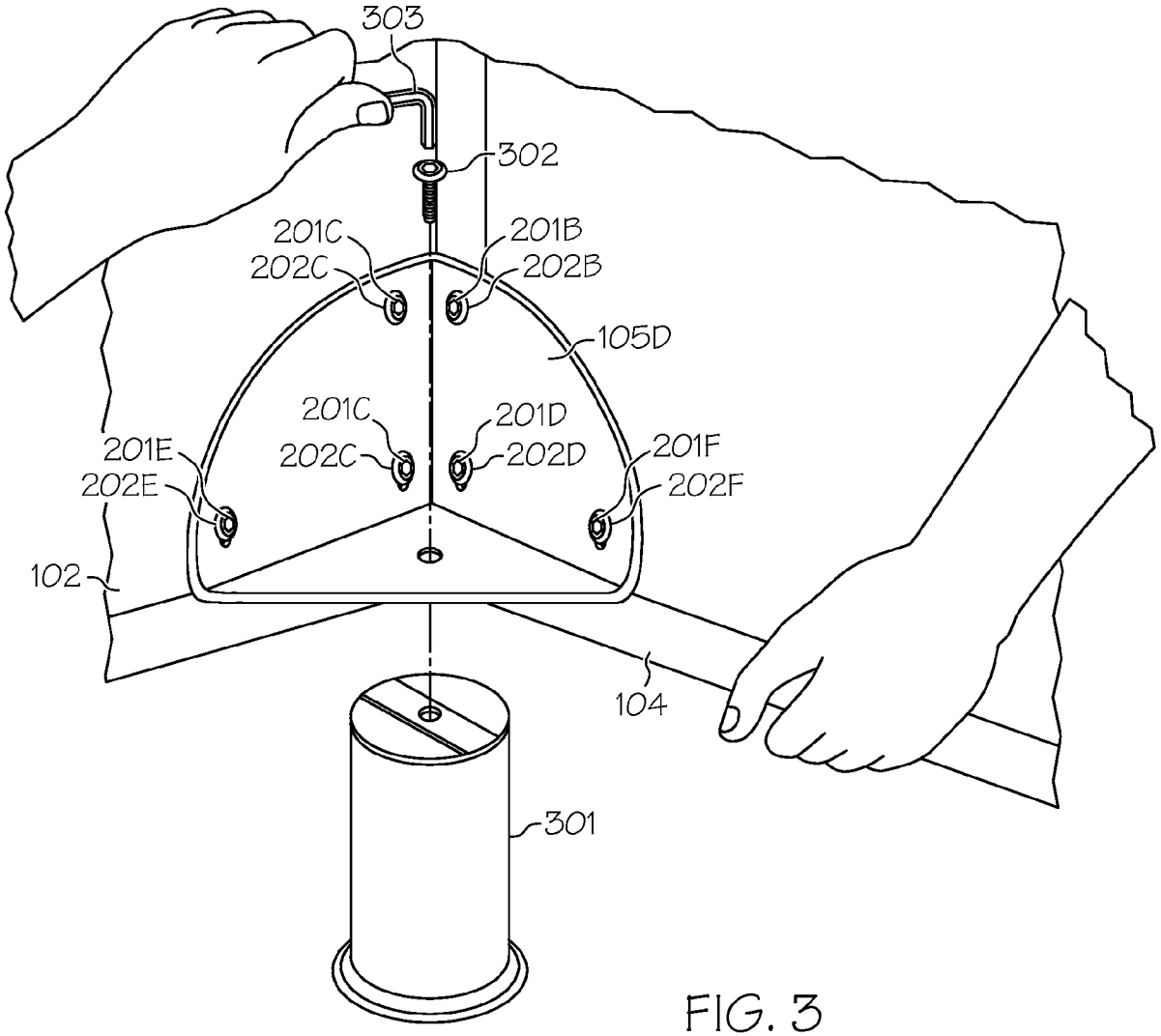
FIG. 3 illustrates a leg being secured to each of the brackets in accordance with an embodiment of the present invention.
Figure 4:
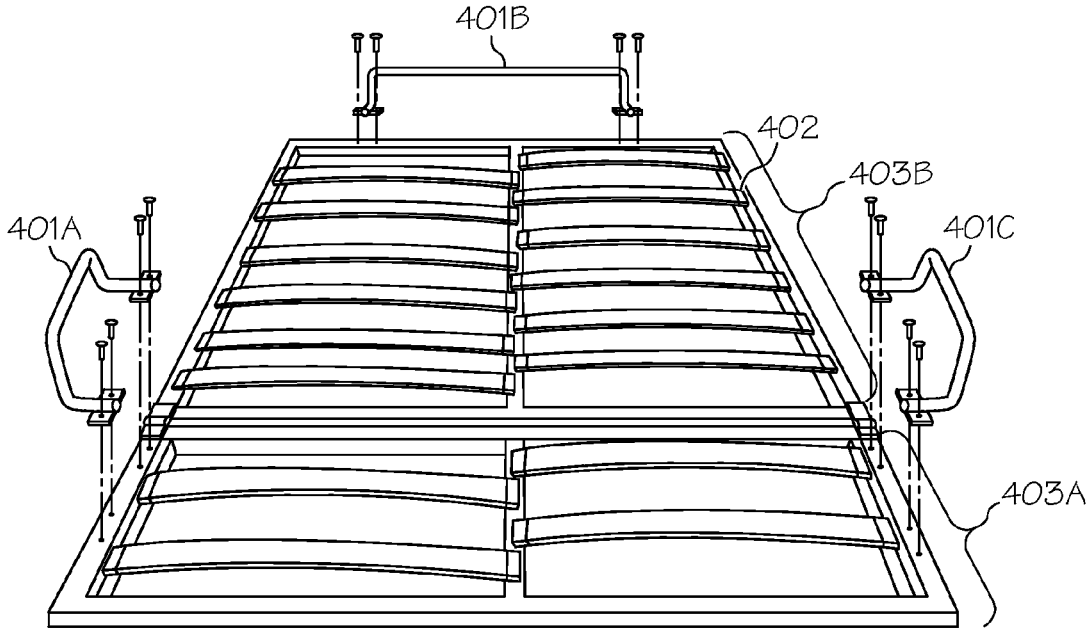
FIG. 4 illustrates guardrails being secured on a second frame that contains a section of slats pivotally connected to the remaining section of slats of the second frame in accordance with an embodiment of the present invention.
Figure 5:
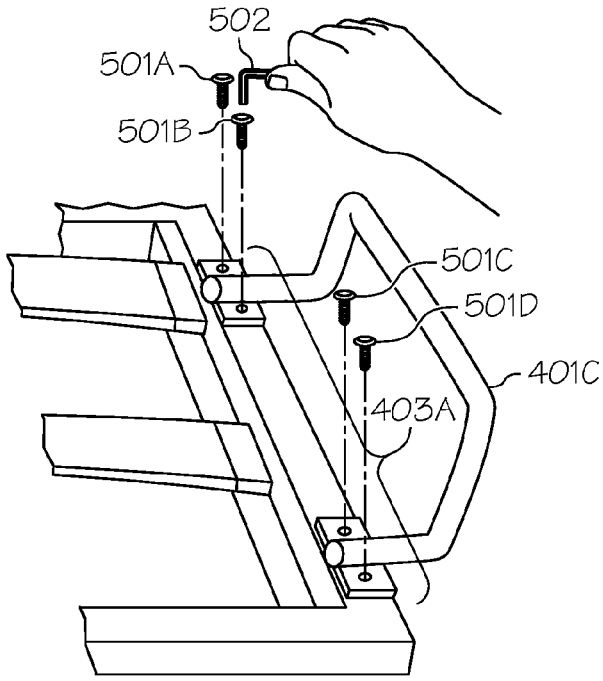
FIG. 5 is an expanded view showing guardrails being connected on the second frame in accordance with an embodiment of the present invention.
Figure 6:
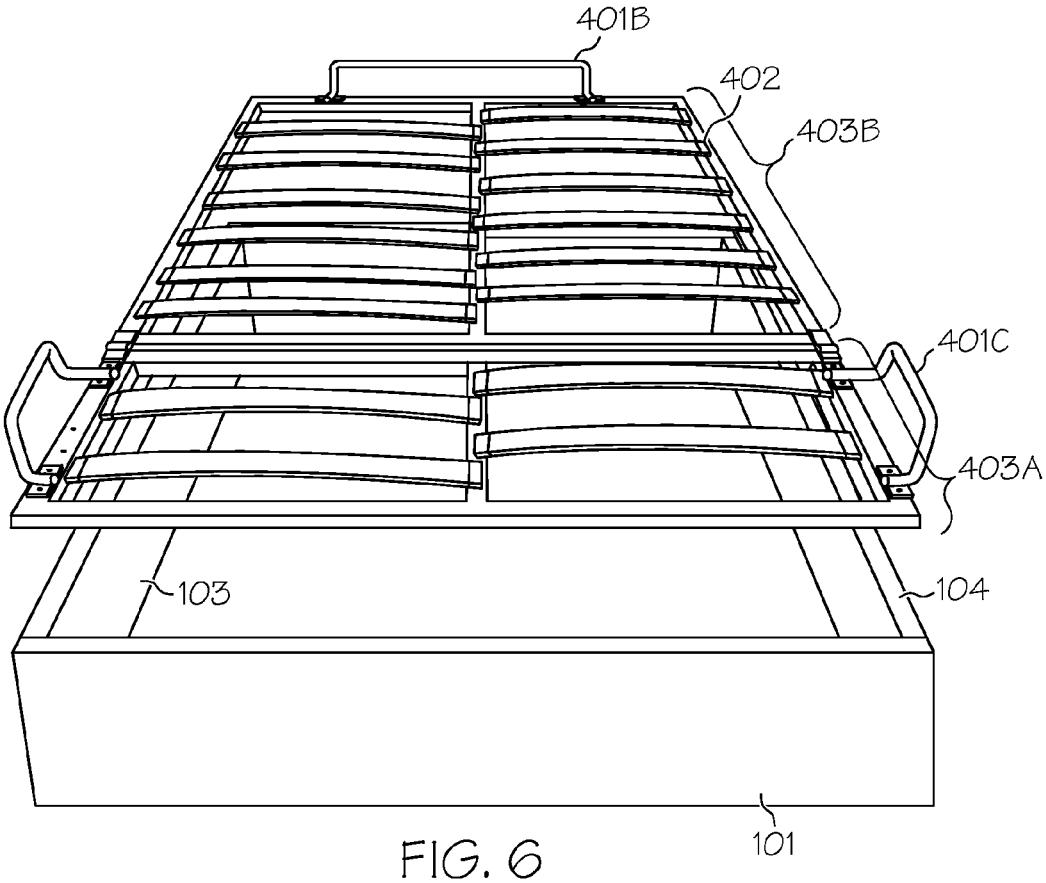
FIG. 6 illustrates securing the second frame to the rear and side rail panels in accordance with an embodiment of the present invention.
Figure 7:
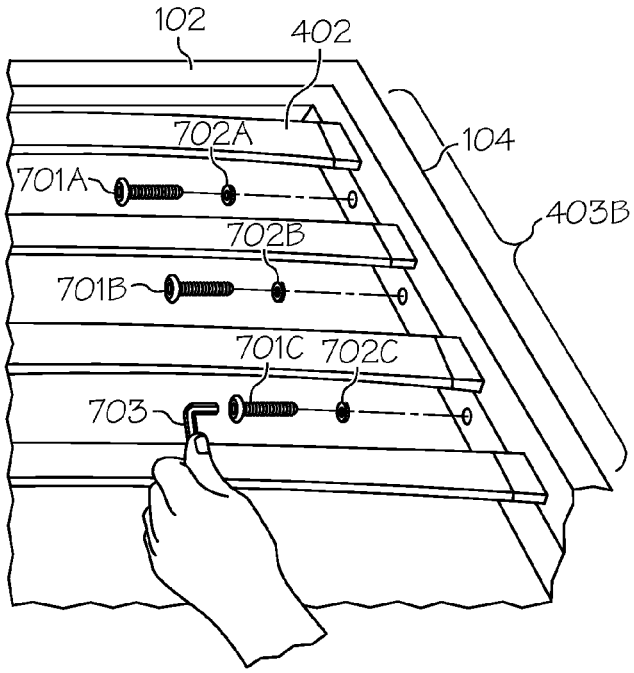
FIG. 7 is an expanded view showing the second frame being secured to the rear and side rail panels in accordance with an embodiment of the present invention.
Figure 8:
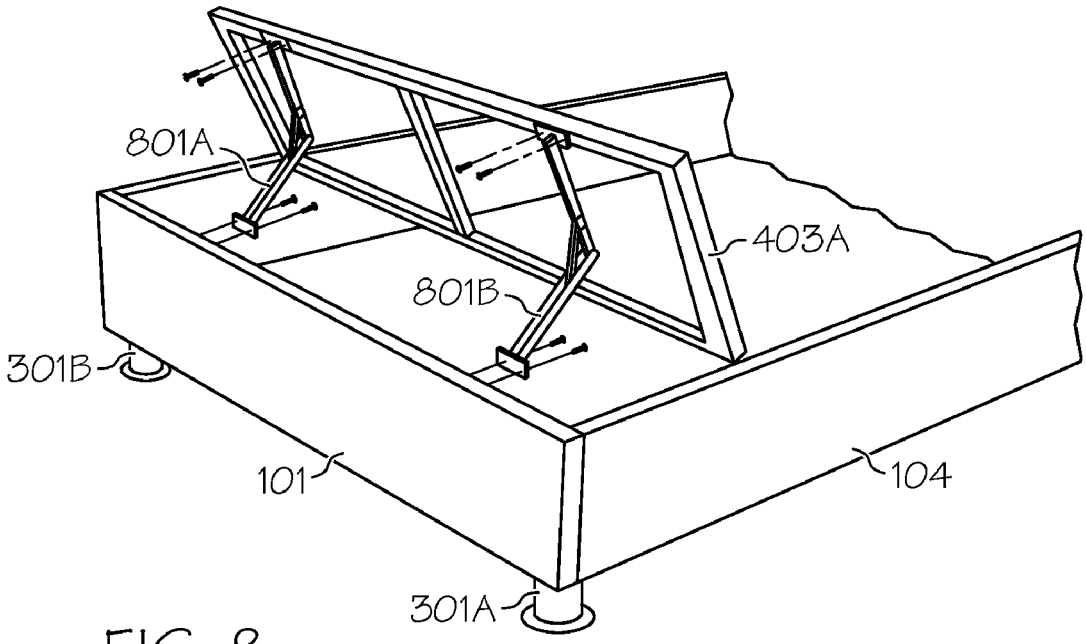
FIG. 8 illustrates two adjustable arms securing the front rail panel with the pivotal section of the slats positioned in the head-rest and back-support sections of the bed frame in accordance with an embodiment of the present invention.
Figure 9:
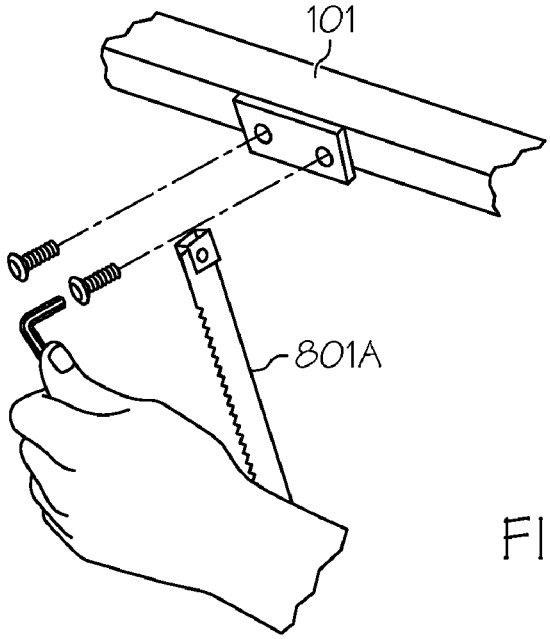
FIG. 9 is an expanded view showing an adjustable arm being secured to the front rail panel and the pivotal section of the slats positioned in the head-rest and back-support sections of the bed frame in accordance with an embodiment of the present invention.
Figure 10:
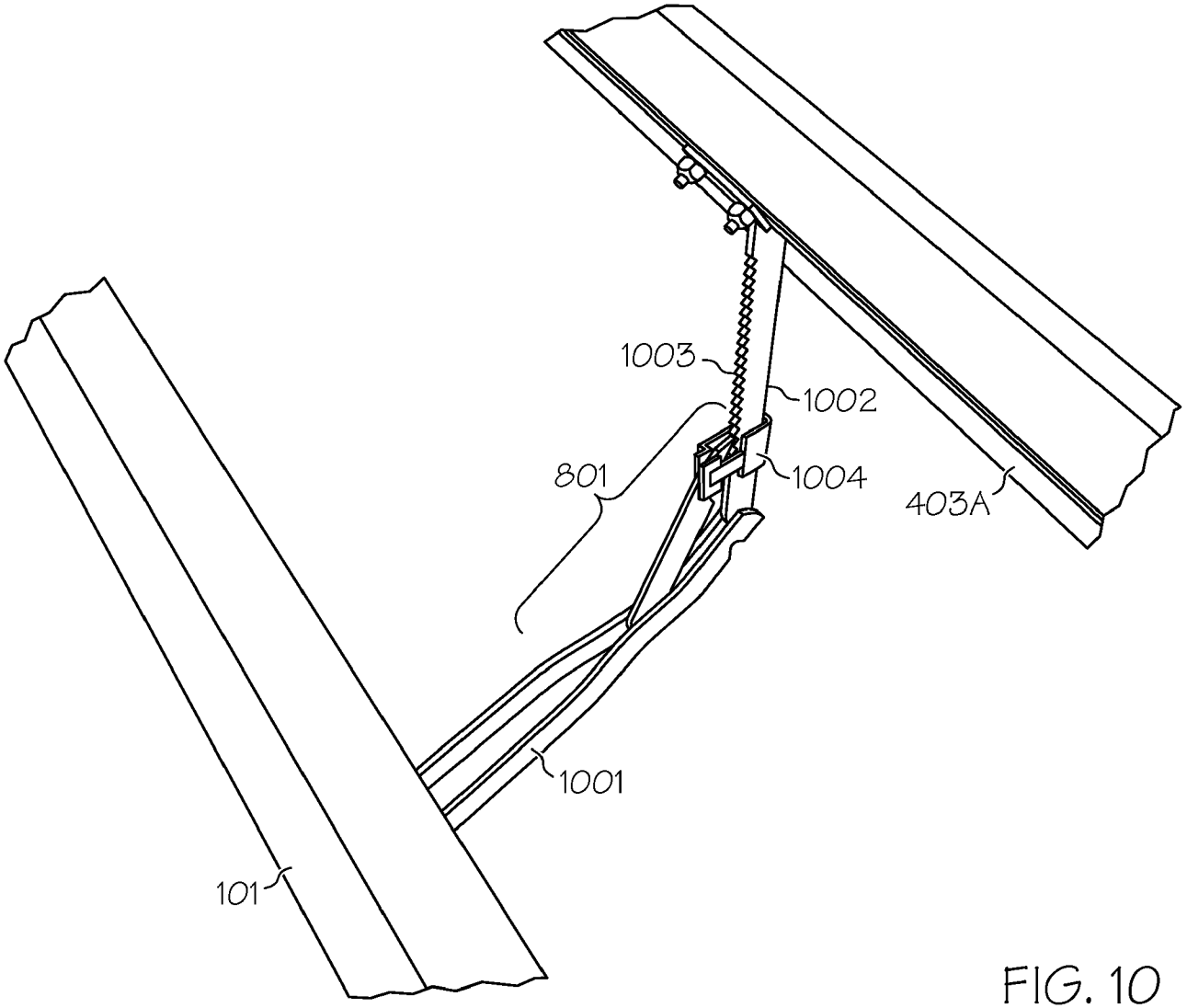
FIG. 10 illustrates the mechanism of the adjustable arms in accordance with an embodiment of the present invention.
Figure 11:
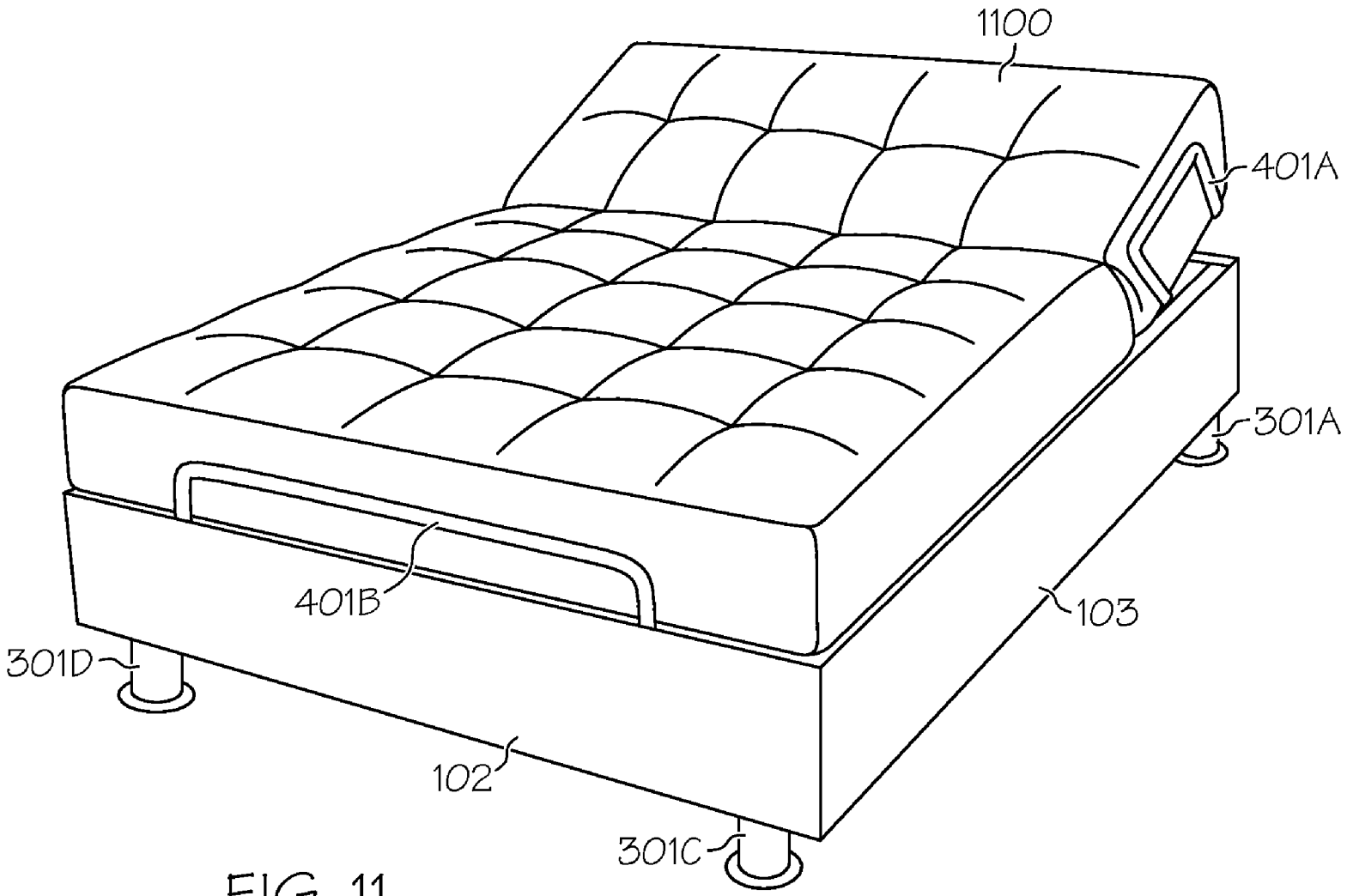
FIG. 11 illustrates a mattress being placed on the bed frame in accordance with an embodiment of the present invention.

The bed frame of the present invention is a less complex manual mechanism configured with the functionality of providing varying degrees of elevation to moveable head-rest and back-support sections of the bed frame as discussed below in connection with FIGS. 1-11. FIG. 1 illustrates a view of the front, rear and side rail panels of the outer first frame of the bed frame. FIG. 2 is an expanded view showing the front and rear rail panels being secured to the side rail panels via brackets. FIG. 3 illustrates a leg being secured to each of the brackets. FIG. 4 illustrates guardrails being secured on the second frame that contains a section of slats pivotally connected to the remaining section of slats on the second frame. FIG. 5 is an expanded view showing guardrails being connected on the second frame. FIG. 6 illustrates securing the second frame to the rear and side rail panels. FIG. 7 is an expanded view showing the second frame being secured to the rear and side rail panels. FIG. 8 illustrates two adjustable arms securing the front rail panel with the pivotal section of the slats positioned in the head-rest and back-support sections of the bed frame. FIG. 9 is an expanded view showing an adjustable arm being secured to the front rail panel and the pivotal section of the slats positioned in the head-rest and back-support sections of the bed frame. FIG. 10 illustrates the mechanism of the adjustable arms. FIG. 11 illustrates a mattress being placed on the bed frame.

Referring to FIG. 1, FIG. 1 illustrates a view of a front rail panel 101, a rear rail panel 102 and two side rail panels 103, 104 of an outer first frame 100 of the bed frame in accordance with an embodiment of the present invention. Front rail panel 101 is secured to the head board end of side rail panels 103, 104 via brackets 105A, 105B. Rear rail panel 102 is secured to the foot board end of side rail panels 103, 104 via brackets 105C, 105D. Brackets 105A-D may collectively or individually be referred to as brackets 105 or bracket 105, respectively. An expanded view showing front and rear rail panels 101, 102 being secured to side rail panels 103, 104 via brackets 105 in accordance with an embodiment of the present invention is provided in FIG. 2.

Referring to FIG. 2, in conjunction with FIG. 1, FIG. 2 illustrates bracket 105D being secured to panels 102, 104 with six long bolts 201A-F and washers 202A-F using an Allen key 203. Bolts 201A-F may collectively or individually be referred to as bolts 201 or bolt 201, respectively. Washers 202A-F may collectively or individually be referred to as washers 202 or washer 202, respectively. While FIG. 2 illustrates bracket 105D being secured to panels 102, 104, the same illustration applies to securing bracket 105 to the other panels (e.g., securing panels 101, 103; securing panels 101, 104; securing panels 102, 103). Further, while FIG. 2 illustrates using six long bolts 201 and washers 202 to secure bracket 105D to panels 102, 104, any number of bolts 201 (including any product of bolts) and washers 202 may be used to secure bracket 105 to the other panels 101, 102, 103, 104.

The outer first frame 100 of the bed frame may be supported from being on the ground using what are referred to as "legs" as illustrated in FIG. 3. Referring to FIG. 3, in conjunction with FIGS. 1 and 2, FIG. 3 illustrates a leg 301 being secured to bracket 105D in accordance with an embodiment of the present invention. While FIG. 3 illustrates leg 301 being secured to bracket 105D, the same illustration applies to securing a leg similar to leg 301 to the other brackets 105 (e.g., brackets 105A, 105B, 105C) in order to support bed frame 100. In one embodiment, leg 301 is secured to bracket 105D with a short bolt 302 using an Allen key 303.

The bed frame further includes a second frame with slats as shown in FIG. 4. FIG. 4 illustrates guardrails 401A, 401B, 401C being secured on a second frame 402 that contains a section of slats 403A pivotally connected to the remaining section of slats 403B of frame 402 in accordance with an embodiment of the present invention. Referring to FIG. 4, guardrail 401A is placed on the left side of frame 402. Guardrail 401B is placed on the foot board end of frame 402 and guardrail 401C is placed on the right side of frame 402. Guardrails 401A, 401B, 401C may collectively or individually be referred to as guardrails 401 or guardrail 401, respectively. In one embodiment, guardrails 401 are used to secure a mattress so that it does not move relative to the boundaries of second frame 402.

Frame 402 may include at least two sections 403A, 403B of slats, where section 403A is pivotally connected to section 403B. Section 403A of frame 402 is positioned in the head-rest and back-support sections of the bed frame and is configurable to be tilted. In this manner, section 403A of frame 402 may be elevated using guardrails 401A, 401C as discussed further below. An expanded view showing guardrails 401 being connected to frame 402 in accordance with an embodiment of the present invention is provided in FIG. 5.

Referring to FIG. 5, in conjunction with FIG. 4, guardrail 401C is connected to section 403A of frame 402 via four bolts 501A-D using an Allen key 502. While FIG. 5 illustrates guardrail 401C being secured to frame 402, the same illustration applies to securing the other guardrails 401 (e.g., guardrails 401A, 401B) to frame 402. Further, while FIG. 5 illustrates using four bolts 501 to secure guardrail 401 to frame 402, any number of bolts 501 may be used to secure guardrail 401 to frame 402.

Frame 402 is secured to the inner portion of panels 101, 102, 103, 104 (FIG. 1) as illustrated in FIG. 6. FIG. 6 illustrates securing frame 402 to the rear and side rail panels 102, 103, 104, respectively, in accordance with an embodiment of the present invention. Referring to FIG. 6, in conjunction with FIGS. 1 and 4, second frame 402 is secured to the inner portion of front rail panel 101, rear rail panel 102 and side rail panels 103, 104. An expanded view showing frame 402 being secured to the inner portion of rear rail panel 102 and side rail panels 103, 104 in accordance with an embodiment of the present invention is provided in FIG. 7.

Referring to FIG. 7, in conjunction with FIG. 6, section 403B of frame 402 is secured to the inner portion of side rail panel 104 with long bolts 701A-C and washers 702A-C using Allen key 703. Long bolts 701A-C may collectively or individually be referred to as long bolts 701 or long bolt 701, respectively. Furthermore, washers 702A-C may collectively or individually be referred to as washers 702 or washer 702, respectively. While FIG. 7 illustrates using three long bolts 701 and washers 702 to connect section 403B of frame 402 to the inner portion of side rail panel 104, any number of bolts 701 and washer 702 may be used to connect section 403B of frame 402 to the inner portion of panel 102, 103 or 104. Further, while FIG. 7 illustrates securing section 403B of frame 402 to the inner portion of side rail panel 104, the same illustration applies to securing section 403B of frame 402 to the inner portion of panel 102 or 103.

Pivotal section 403A of frame 402 is connected to front rail panel 101 (FIG. 1) as illustrated in FIG. 8. FIG. 8 illustrates two adjustable arms 801A, 801B securing front rail panel 101 with section 403A (section of slats positioned in the head-rest and back-support sections of the bed frame) in accordance with an embodiment of the present invention. Referring to FIG. 8, in conjunction with FIGS. 1 and 4, legs 301A, 301B (similar to leg 301 in FIG. 3) support outer first frame 100. FIG. 8 further illustrates two adjustable arms 801A, 801B connecting pivotal section 403A of second frame 402 with front fail panel 101. In this manner, pivotal section 403A of frame 402 is able to be elevated in many positions (e.g., 18 different positions) thereby providing varying degrees of elevation to the moveable head-rest and back-support sections of the bed frame. Adjustable arms 801A, 801B may collectively be referred to as adjustable arms 801 or adjustable arm 801, respectively. An expanded view showing adjustable arm 801 being secured to front rail panel 101 and section 403A of frame 402 in accordance with an embodiment of the present invention is provided in FIG. 9. A detailed illustration showing the mechanism of adjustable arm 801 in accordance with an embodiment of the present invention is provided in FIG. 10.

Referring to FIG. 9, in conjunction with FIG. 8, adjustable arm 801A is connected to front rail panel 101 with two short bolts 901A, 901B using an Allen key 902. Bolts 901A, 901B may collectively or individually be referred to as bolts 901 or bolt 901, respectively. While FIG. 9 illustrates using two bolts 901 to secure adjustable arm 801A to front rail panel 101, any number of bolts 901 may be used to secure adjustable arm 801A to front rail panel 101. Further, while FIG. 9 illustrates securing adjustable arm 801A to front rail panel 101, the same illustration applies to securing adjustable arm 801A to section 403A of frame 402 as well as securing adjustable arm 801B to front rail panel 101/section 403A of frame 402.

Referring to FIG. 10, in conjunction with FIGS. 4 and 8, adjustable arm 801 includes a support arm 1001 and a lever arm 1002, where support attn 1001 is coupled to front rail panel 101 and to one end of lever arm 1002. Lever arm 1002 is coupled to section 403A of frame 402. As illustrated in FIG. 10, lever arm 1002 includes a series of notches 1003 (18 in this example to represent the 18 different positions that pivotal section 403A of frame 402 may be elevated), where each notch 1003 represents a particular elevated position of pivotal section 403A of frame 402. A guide mechanism 1004 may be used to select a particular notch 1003 of lever arm 1002 in order to select the elevated position of pivotal section 403A of frame 402. In one embodiment, a user may cause guide mechanism 1004 to slide up and down the notches 1003 of lever arm 1002 via the upward and downward movement of pivotal section 403A of frame 402. In one embodiment, a user may move pivotal section 403A of frame 402 via guardrails 401A, 401C.

Once the bed frame of the present invention has been completely assembled as shown and explained in connection with FIGS. 1-10, a mattress may be placed on bed frame as illustrated in FIG. 11. FIG. 11 illustrates a mattress 1100 being placed on the bed frame in accordance with an embodiment of the present invention. Referring to FIG. 11, in conjunction with FIGS. 1-10, FIG. 11 illustrates legs 301A, 301C, 301D (similar to leg 301 in FIG. 3) supporting outer frame 100. As shown in FIG. 11, a user lifts section 403A of frame 402 using one of the guardrails 401A, 401C (guardrails 401 on one of the sides of frame 402) to place section 403A of frame 402 in one its tilting positions. In one embodiment, section 403A of frame 402 includes multi-tilting positions (e.g., 18 different tilting positions). In one embodiment, each tilting position is secured by a locking mechanism (guide mechanism 1004 of FIG. 10) which produces a clicking sound each time section 403A of frame 402 is locked in one of the tilting positions. Section 403A of frame 402 may be returned from a tilting position to a flat position by lifting section 403A to the highest tilting position to release the locking mechanism and then guiding section 403A to the flat position.

Although the bed frame is described in connection with several embodiments, it is not intended to be limited to the specific forms set forth herein, but on the contrary, it is intended to cover such alternatives, modifications and equivalents, as can be reasonably included within the spirit and scope of the invention as defined by the appended claims.

The invention claimed is:

1. A bed frame, comprising:

a first frame comprising:

two side rail panels;

a front rail panel secured at a head board end of each of said two side rail panels via a first and a second bracket; and a rear rail panel secured at a foot board end of each of said two side rail panels via a third and a fourth bracket;

a leg secured to each of said first, second, third and fourth brackets to support said first frame;

a second frame with slats secured to the inner portions of said front rail panel, said rear rail panel and said two side rail panels of said first frame, wherein said second frame with slats comprises a first section of slats pivotally connected to a second section of slats, wherein said first section of slats is positioned in head-rest and back-support sections of said bed frame configurable to be tilted;

a first guardrail placed on the foot board end of said second frame with slats to secure a mattress so that it does not move relative to the boundaries of said second frame with slats;

a second guardrail placed on one side of said second frame with slats to further secure said mattress so that it does not move relative to the boundaries of said second frame with slats;

a third guardrail placed on an opposite side of said second frame with slats to further secure said mattress so that it does not move relative to the boundaries of said second frame with slats; and two adjustable arms secured to said front rail panel and to said first section of slats of said second frame thereby providing tilting capability of said first section of slats of said second frame, wherein each of said two adjustable arms comprises a support arm and a lever arm, wherein said support arm is coupled to said front rail panel and to one end of said lever arm, wherein said lever arm comprises a plurality of notches, wherein each of said plurality of notches corresponds to an elevated position of said first section of slats of said second frame, wherein a guide mechanism is used to select a particular notch of said plurality of notches.

2. The bed frame as recited in claim 1, wherein said leg is secured to each of said first, second, third and fourth bracket via a bolt.

3. The bed frame as recited in claim 1, wherein said front rail panel and said rear rail panel is secured to said two side rail panels using six bolts and washers for each of said first, second, third and fourth bracket.

4. The bed frame as recited in claim 1, wherein said first guardrail is secured to said foot board end of said second frame with slats via four bolts.

5. The bed frame as recited in claim 1, wherein said second guardrail is secured to one side of said second frame with slats via four bolts, wherein said third guardrail is secured to the opposite side of said second frame with slats via four bolts.

6. The bed frame as recited in claim 1, wherein said second frame is metal.

7. The bed frame as recited in claim 1, wherein said second frame is secured to said rear rail panel and said two side rail panels via bolts.

8. The bed frame as recited in claim 1, wherein said first section of slats of said second frame is configurable to be tilted in 18 different levels of elevation.

9. The bed frame as recited in claim 1, wherein said two adjustable arms are secured to said front rail panel and to said first section of slats of said second frame using bolts.

10. The bed frame as recited in claim 1, wherein a user lifts said first section of slats of said second frame using one of said second and third guardrails to place said first section of slats of said second frame in a first tilting position.

11. The bed frame as recited in claim 10, wherein said first tilting position is secured in placed by releasing to a sound of a click.

12. The bed frame as recited in claim 11, wherein said first tilting position of said first section of slats of said second frame is returned to a flat position by lifting said first section of slats of said second frame to a highest tilting position to release a locking mechanism and then guiding said first section of slats of said second frame down to said flat position.

13. A bed, comprising:

a bed frame, comprising:

a first frame comprising:

two side rail panels;

a front rail panel secured at a head board end of each of said two side rail panels via a first and a second bracket; and a rear rail panel secured at a foot board end of each of said two side rail panels via a third and a fourth bracket;

a leg secured to each of said first, second, third and fourth brackets to support said first frame;

a second frame with slats secured to the inner portions of said front rail panel, said rear rail panel and said two side rail panels of said first frame, wherein said second frame with slats comprises a first section of slats pivotally connected to a second section of slats, wherein said first section of slats is positioned in head-rest and back-support sections of said bed frame configurable to be tilted;

a first guardrail placed on the foot board end of said second frame with slats to secure a mattress so that it does not move relative to the boundaries of said second frame with slats;

a second guardrail placed on one side of said second frame with slats to further secure said mattress so that it does not move relative to the boundaries of said second frame with slats;

a third guardrail placed on an opposite side of said second frame with slats to further secure said mattress so that it does not move relative to the boundaries of said second frame with slats; and two adjustable arms secured to said front rail panel and to said first section of slats of said second frame thereby providing tilting capability of said first section of slats of said second frame, wherein each of said two adjustable arms comprises a support arm and a lever arm, wherein said support arm is coupled to said front rail panel and to one end of said lever arm, wherein said lever arm comprises a plurality of notches, wherein each of said plurality of notches corresponds to an elevated position of said first section of slats of said second frame, wherein a guide mechanism is used to select a particular notch of said plurality of notches; and a mattress placed on said bed frame.

14. The bed as recited in claim 13, wherein said leg is secured to each of said first, second, third and fourth bracket via a bolt.

15. The bed as recited in claim 13, wherein said front rail panel and said rear rail panel is secured to said two side rail panels using six bolts and washers for each of said first, second, third and fourth bracket.

16. The bed as recited in claim 13, wherein said first guardrail is secured to said foot board end of said second frame with slats via four bolts.

17. The bed as recited in claim 13, wherein said second guardrail is secured to one side of said second frame with slats via four bolts, wherein said third guardrail is secured to the opposite side of said second frame with slats via four bolts.

18. The bed as recited in claim 13, wherein said second frame is metal.

19. The bed as recited in claim 13, wherein said first section of slats of said second frame is configurable to be tilted in 18 different levels of elevation.

20. The bed as recited in claim 13, wherein said two adjustable arms are secured to said front rail panel and to said first section of slats of said second frame using bolts.

21. A mechanism for providing tilting capability comprising:

a support arm coupled to a first frame;

a lever arm coupled to an end of said support arm and to a first section of a second frame, wherein said lever arm comprises a plurality of notches, wherein each of said plurality of notches corresponds to an elevated position of said first section of said second frame; and a guide mechanism coupled to said support arm and to said lever arm, wherein said guide mechanism is used to select a particular notch of said plurality of notches thereby providing tilting capability of said first section of said second frame.

* * * * *